United States Patent [19]

De Luca et al.

[11] Patent Number: 4,840,572

[45] Date of Patent: Jun. 20, 1989

[54] TELEPHONE CONNECTOR BLOCK HAVING SERIALLY INTERCONNECTIBLE GROUNDING STRIP

[75] Inventors: Paul V. De Luca, Plandome Manor; Helmuth Neuwirth, Garden City, both of N.Y.

[73] Assignee: Porta Systems Corp., Syosset, N.Y.

[21] Appl. No.: 199,057

[22] Filed: May 26, 1988

[51] Int. Cl.[4] ..... H01R 9/24; H01R 13/28

[52] U.S. Cl. ..... 439/92; 439/290; 439/717; 439/850

[58] Field of Search ..... 439/92, 284, 290, 291, 439/601, 651, 842, 845, 849, 850, 856–858, 861, 682–691, 74, 717, 108

[56] References Cited

U.S. PATENT DOCUMENTS

| | | | |
|---|---|---|---|
| 2,448,339 | 8/1948 | Williams | 439/651 |
| 4,073,564 | 2/1978 | Davis, Jr. | 439/651 |
| 4,322,120 | 3/1982 | Rilling | 439/717 |
| 4,415,214 | 11/1983 | Obst | 439/717 |

FOREIGN PATENT DOCUMENTS

| | | | |
|---|---|---|---|
| 0117021 | 8/1984 | European Pat. Off. | 439/691 |
| 2220891 | 10/1974 | France | 439/651 |

*Primary Examiner*—Gary F. Paumen

*Attorney, Agent, or Firm*—Charles E. Temko

[57] ABSTRACT

A quick clip telephone connector block having a grounding strip extending axially along an exposed surface thereof, the grounding strip having means for electrical and mechanical interconnection with the grounding strip of a second axially aligned block for ultimate connection with a source of ground potential.

2 Claims, 2 Drawing Sheets

TELEPHONE CONNECTOR BLOCK HAVING SERIALLY INTERCONNECTIBLE GROUNDING STRIP

RELATED APPLICATION

Reference is made to the copending application of Paul V. DeLuca, et al., Serial No. 144,040 filed Jan. 15, 1988 and assigned to the same assignee as the instant application, which discloses and claims a related invention.

BACKGROUND OF THE INVENTION

This invention relates generally to the field of telephony, and more particularly to an improved ground strip construction for use with telephone subscriber circuit connector blocks which are mounted upon a mainframe in axially aligned relation, the ground strip construction of each block being interconnectible in serial fashion to provide communication to a source of ground potential. Ground strip provision in telephone connector blocks are known in the art, and the invention lies in specific constructional details which materially improve both ease of manufacture, and, more importantly, ease in installation.

On mainframes carrying a relatively large number of connector blocks in closely spaced relation, difficulty has been experienced in providing a grounding strip which will conveniently communicate with each of the subscriber circuits, and be accessible for connection to a source of ground potential, usually the mainframe itself. In the past, the problem has been solved by providing separate protector blocks carrying individual protector modules. This solution effectively reduces the available subscriber circuit density, and adds to the cost of each subscriber circuit installation. A more desirable solution is the provision of a ground strip for each connector block, but in such case, means must be provided for interconnecting such strips to a grounded conductor. When the connector blocks are mounted upon the mainframe in aligned abutting relation, the provision of a ground strip spanning all of the blocks and interconnected with each of them is not readily accomplished.

SUMMARY OF THE INVENTION

Briefly stated, the invention contemplates the provision of a series of individual ground strips, one for each aligned connector block, each strip having a mating head and tail portion providing for serial interconnection as the blocks are mounted upon the mainframe. To this end, the strip is of U-shaped cross-section forming a planar socket including resilient detent means at a tail end thereof, and a planar projection engageable within another said socket to be retained thereby, the strip normally being carried on an exposed surface of the block prior to frame mounting.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
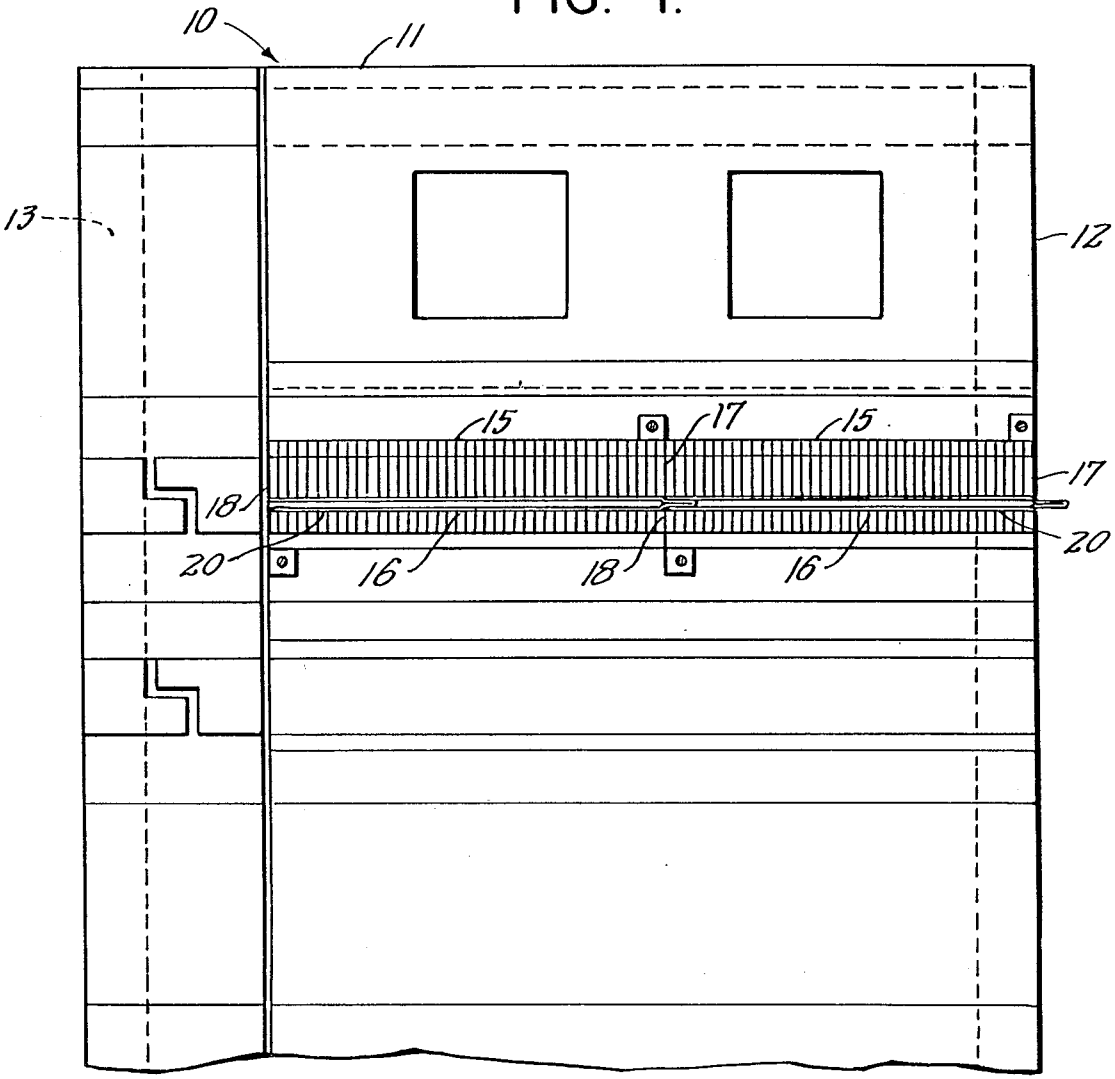
FIG. 1 is a view in elevation of a telephone mainframe embodying the invention and showing a plurality of telephone connector blocks mounted thereon in axially aligned relation.

In accordance with the invention, reference character 10 designates a known telephone mainframe element bounded by vertical side walls 11 and 12, and carrying a cable trough 13 at one side thereof. Supported by a transversely extending bracket are a pair of connector blocks 15 of quick clip type, each having an exposed surface forming an elongated channel 16 extending from a first end 17 to a second end 18. When the blocks are in mutually aligned relation, the channels 16 of each block communicate.

Figure 2:
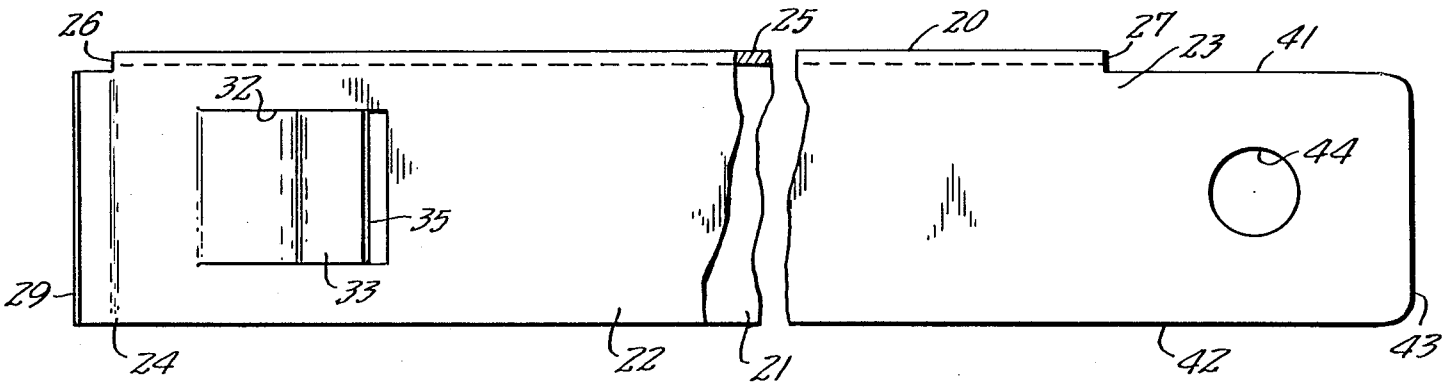
FIG. 2 is a fragmentry enlarged view in elevation showing an individual ground strip element forming a part of the disclosed embodiment.

Referring to FIG. 2, each of the blocks carries a ground strip element, generally indicated by reference character 20, most conveniently formed from a single blank of solder plated brass alloy. The element 20 includes first and second side walls 21 and 22 extending between a leading end 23 and a trailing end 24, joined by a bent interconnecting portion 25, the portion 25 extending between a first end 26 and a second end 27. Flared extensions 28 and 29 form an entrance into a generally planar channel 30 at the trailing end 24.

Figure 3:
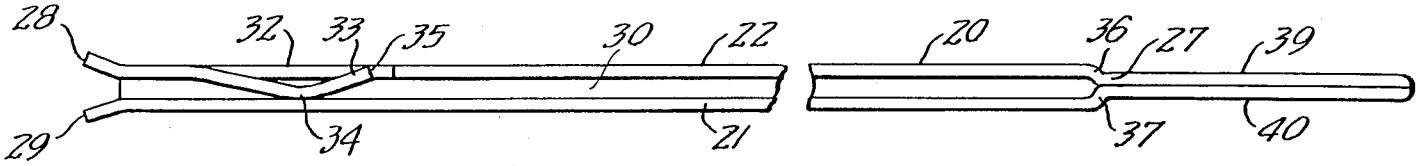
FIG. 3 is a fragmentary enlarged view in elevation, partly in section, as seen from the lower portion of FIG. 2.
Figure 4:
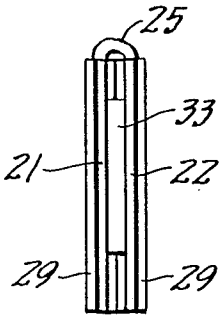
FIG. 4 is an end elevational view thereof.

The wall 21 is provided with a rectangular opening 32 formed by cutting a resilient rectangular tab 33 and bending the same as shown in FIG. 3. The tab includes a medially disposed portion 34 forming a contact surface and end terminals in a free edge 35.

Each of the walls 21 and 22 is provided with an offset portion 37–38 leading to abutted planar segments 39 and 40 bounded by side edges 41 and 42 and abutted end edges 43. Extending through the segments 39–40 is an aligned opening 44 permitting the engagement of a wire conductor ( not shown), when required.

Referring again to FIG. 1, the ground strip element 20 may be incorporated into the individual connector blocks prior to assembly on the mainframe, and joined head to tail as the blocks are assembled. The tail portion of the leftward strip is adapted to bear directly upon the side wall 11 which will normally be grounded, and, if necessary, the head end of the rightward strip 20 may be interconnected to provide a ground connection to any otherwise upgrounded equipment on the mainframe.

We wish it to be understood that we do not consider the invention to be limited to the precise details of structure shown and set forth in this specification, for obvious modifications will occur to those skilled in the art to which the invention pertains.

We claim:

1. Telephone connector block construction comprising in combination: a plurality of connector blocks in abutted relation, each of said blocks having an exposed surface forming an elongated channel extending between first and second ends of said block, said channels communicating in end to end relation; an elongated ground strip element carried in each of said channels, and extending the length thereof, each of said ground strip elements including first and second side walls, and an axially oriented bent interconnecting portion, one end of said side walls having flared extensions forming an entrance to a planar chanell formed between said side walls, a second end of each of said side walls having an offset portion leading to a planar segment in abutted relation with respect to a corresponding planar segment on the other of said side walls to form a planar contact; whereby the placing of said connector blocks in abutted relation serves to engage said planar contact of one of said ground strip elements into engagement with a planar channel in an adjacent said ground strip element.

2. Telephone connector block construction in accordance with claim 1, further characterized in one of said first and second side walls having a rectangular opening therethrough surrounding a resilient tab, said tab having a contact surface engaging a planar contact of an adjacent ground strip element.

* * * * *